US007004341B2

(12) United States Patent
Shenkar et al.

(10) Patent No.: US 7,004,341 B2
(45) Date of Patent: Feb. 28, 2006

(54) TAMPER EVIDENT COMPOSITE CLOSURE WITH THREADLESS SECUREMENT

(75) Inventors: Emanuel Shenkar, Worth, IL (US); James L. Martin, Lancaster, OH (US); Galen German, Lancaster, OH (US); Min Miles Wan, Plainfield, IL (US); Chris Ramsey, Wantage (GB)

(73) Assignee: Crown Cork & Seal Technologies, Corporation, Alsip, IL (US)

( * ) Notice: Subject to any disclaimer, the term of this patent is extended or adjusted under 35 U.S.C. 154(b) by 0 days.

(21) Appl. No.: 10/041,232

(22) Filed: Jan. 7, 2002

(65) Prior Publication Data

US 2003/0127419 A1 Jul. 10, 2003

(51) Int. Cl.
*B65D 41/32* (2006.01)

(52) U.S. Cl. ..... 215/256; 215/274; 215/276; 215/258; 215/252; 215/901; 220/319; 220/214; 220/796

(58) Field of Classification Search ..... 215/274, 215/258, 256, 252, 276, 901, 317, 321, 45; 220/796, 319, 214
See application file for complete search history.

(56) References Cited

U.S. PATENT DOCUMENTS

| | | | | | |
|---|---|---|---|---|---|
| 1,740,881 | A | * | 12/1929 | Taliaferro | 215/274 |
| 3,369,689 | A | | 2/1968 | Dodge | |
| 4,378,893 | A | * | 4/1983 | Wilde et al. | 215/246 |
| 4,457,438 | A | * | 7/1984 | Varlet et al. | 215/252 |
| 4,540,099 | A | * | 9/1985 | Swartzbaugh et al. | 215/252 |
| 4,579,241 | A | * | 4/1986 | Hayes | 215/252 |
| 4,645,087 | A | * | 2/1987 | Kusz | 215/274 |
| 4,694,970 | A | * | 9/1987 | Hayes | 215/252 |
| 4,730,745 | A | * | 3/1988 | Perry | 215/274 |
| 4,782,976 | A | * | 11/1988 | Kenyon, 2nd. | 220/781 |
| 4,957,210 | A | * | 9/1990 | Kusz | 215/220 |
| 5,197,602 | A | * | 3/1993 | Biesecker et al. | 206/514 |
| 5,341,949 | A | * | 8/1994 | Hayes | 215/274 |
| 5,544,770 | A | * | 8/1996 | Travisano | 215/230 |
| 5,566,854 | A | | 10/1996 | Rojek | |
| 5,850,951 | A | * | 12/1998 | Hayes | 222/525 |
| 5,875,906 | A | * | 3/1999 | Price et al. | 215/252 |
| 5,881,897 | A | | 3/1999 | Rojek | |
| 5,904,266 | A | * | 5/1999 | Tedeschi, Jr. | 220/521 |

FOREIGN PATENT DOCUMENTS

| | | | |
|---|---|---|---|
| EP | 0 413 466 A1 | | 2/1991 |
| GB | 2225314 A | * | 5/1990 |
| WO | WO 96/10522 | | 4/1996 |

* cited by examiner

*Primary Examiner*—Robin Hylton
(74) *Attorney, Agent, or Firm*—Knoble Yoshida & Dunleavy, LLC

(57) ABSTRACT

A composite closure type container assembly that is designed for use with unthreaded containers includes a container having an unthreaded outer surface and an opening that is defined by an upper rim, a sealing disc that is sized and shaped to cover the opening and to seal against the upper rim and a securement member that is removably anchored to the container for securing the sealing disc on the container. In one embodiment, the securement member is removably anchored to the container by using a tight frictional engagement. In a second embodiment, the anchoring is accomplished by shaping the container so as to have a downwardly depending skirt that engages and retains the securement member in position until the container assembly is opened.

10 Claims, 4 Drawing Sheets

TAMPER EVIDENT COMPOSITE CLOSURE WITH THREADLESS SECUREMENT

BACKGROUND OF THE INVENTION

1. Field of the Invention

This invention relates to an improved tamper evident composite closure, its method of manufacturing and its method of use. More specifically, this invention provides a composite closure that is compatible with a container that lacks conventional retention structure near the opening of the container that is to be sealed.

2. Description of the Related Technology

Conventional composite closures typically include a molded plastic ring or skirt portion that is internally threaded so as to be securable onto an externally threaded portion of a container and a metallic cover or disc which is inserted into the upper portion of the ring for completing the closure. The underside of the metallic cover or disc typically has an annular groove defined therein in which a gasket material such as plastisol is positioned so that a tight seal is formed between the metallic cover or disc and the upper rim of the externally threaded portion of the container. Such conventional composite closures are typically used to seal containers made of glass or plastic that are molded to have a finish portion that is provided with external threading or other conventional retention structure. One advantage of such closures is that the skirt portion can be designed so as to be visibly tamper evident, so that the consumer is made aware if the contents of the container have been accessed after completion of the packaging process.

Within the industry, it has generally been assumed that such conventional retention structure is necessary to retain the molded plastic ring or skirt portion onto the container, and that the inclusion of the molded plastic ring or skirt portion is a practical necessity for keeping the metallic cover or disc positioned on the container for the packaging of most consumer products, especially foodstuffs. Accordingly, containers that lack such retention structure, which includes most practically available metal containers, have not generally been considered suitable for conventional composite closures. Closure assemblies are known that simply include a metallic cover or disc, which is retained on the container simply by a vacuum that is induced within the container. Such closure assemblies do not require retention structure on the container because there is no plastic ring or skirt portion. In order to open such an assembly, a consumer will either breach the seal of the cover or disc, such as by removing a plug, or pry the disc from the container with his or her fingernails or a tool in order to break the vacuum. Although such closure assemblies are appropriate for some purposes, conventional composite closures are preferred for a number of reasons, prominent among which are the factors of tamper evident construction discussed above.

A need exists for a composite closure that is compatible with a container that lacks conventional retention structure, such as external threading and that is tamper evident so that consumers will be forewarned if the closure has been previously opened.

SUMMARY OF THE INVENTION

Accordingly, it is an object of the invention to provide a composite closure that is compatible with a container that lacks conventional retention structure, such as external threading and that is tamper evident so that consumers will be forewarned if the closure has been previously opened. It is further an object of the invention to provide a method of making such a closure, and a method of using such a closure.

In order to achieve the above and other objects of the invention, a composite closure that is constructed according to a first aspect of the invention for sealing a container having an outer surface and an opening that is defined by an upper rim includes a sealing disc that is sized and shaped to cover the opening, the sealing disc having a surface on a lower side thereof that is constructed and arranged to contact and form a seal with the upper rim of the container; and securement structure for securing the sealing disc on the container without engaging any threading that may be defined on the container.

According to a second aspect of the invention, a container assembly includes a container that has an outer surface that does not include any threading for retaining a closure and an opening that is defined by an upper rim, a sealing disc that is sized and shaped to cover the opening, the sealing disc having a surface on a lower side thereof that is constructed and arranged to contact and form a seal with the upper rim of the container; and securement structure, removably anchored to the container, for securing the sealing disc on the container.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
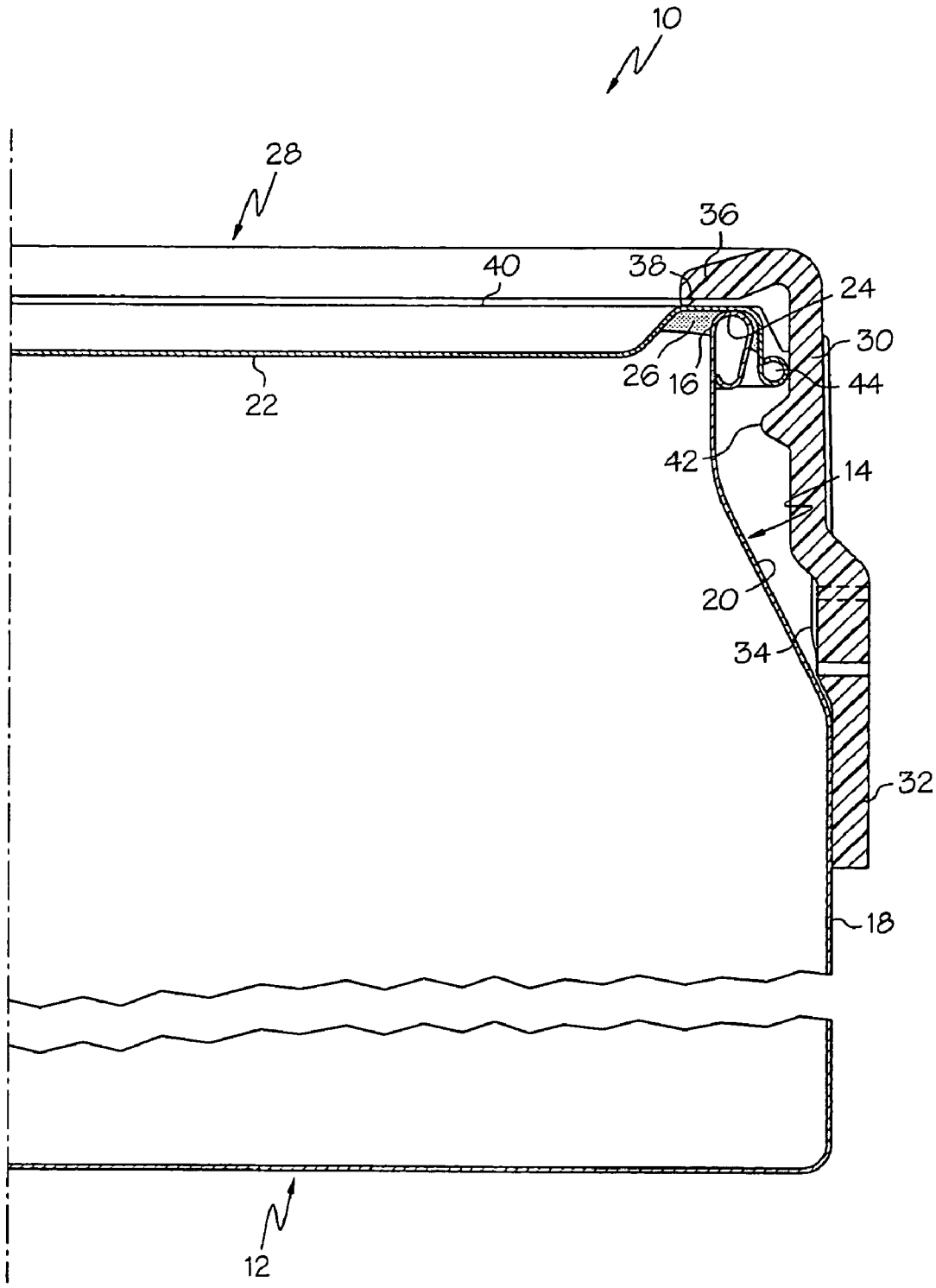
FIG. 1 is a fragmentary cross-sectional view of a container assembly that is constructed according to a first embodiment of the invention.

Referring again to FIG. 1, it will be seen that container assembly 10 further includes a sealing disc 22 that is sized and shaped to cover the opening that is defined in the container 12. Sealing disc 22 has a surface, which in the preferred embodiment is a concave annular recess 24, on a lower side thereof that is constructed and arranged to contact and form a seal with the upper rim 16 of the container 12. As is clearly shown in the drawings, container 12 and sealing disc 22 are engaged so that only the sealing surface engages the container 12. As is conventional in such composite closures, gasket material 26 such as plastisol is provided within the concave annular recess 24 to facilitate airtight sealing between the sealing disc 22 and the upper rim 16 of the container 12.

A securement member 28 that is removably anchored to the container 12 in a manner that will be described in greater detail below is further provided for securing the sealing disc 22 onto the container 12. Securement member 28 is preferably fabricated from a plastic material such as polypropylene or polyethylene. Securement member 28 includes in the preferred embodiment a removable upper portion 30 that is constructed and arranged to be removed from the container assembly 10 by a consumer during opening and a tamper evident band 32 that is frangibly connected to the removable upper portion 30 by a plurality of frangible bridge elements 34. Preferably, the removable upper portion 30, the tamper evident band 32 and the bridge elements 34 are integrally molded as a single piece, although alternatively it is possible to mold the components separately and to weld them together such as by using ultrasonic techniques during the manufacturing process.

As is shown in FIG. 1, securement member 28 is shaped so as to define an upper opening through which the upper surface 40 of the sealing disc 22 will be visible by a consumer prior to opening. Securement member 28 further includes an upper inwardly extending annular flange 36 that is shaped so as to overlie an outermost area of the sealing disc 22 and the upper rim 16 of the container 12. Annular flange 36 includes a lower surface 38 that is constructed and arranged to bear downwardly against the upper surface 40 of the sealing disc 22 after the container assembly 10 has been assembled during the manufacturing/packaging process so that the securement member 28 ensures that the sealing disc 22 remains securely in place with respect to the container 12. This is not necessary in order to retain the sealing disc 22 on the container 12, because the vacuum within the container 12 will be sufficient to keep the sealing disc 22 appropriately positioned. However, it ensures against premature unseating of the sealing disc 22 from the container 12, which would break the vacuum seal and jeopardize the contents of the container 12. In addition, the presence of the securement member 28 provides a tamper evident dimension so that the consumer will readily be able to ascertain if the container assembly 10 has been previously opened or not.

In the manufacturing process, the securement member 28 will be preassembled with the sealing disc 22 into a prefabricated closure. In the packaging process, this prefabricated closure will be assembled with a container 12 so that the sealing disc 22 is seated on to the upper rim 16 of the container 12. This may be done in an underpressurized environment, so as to induce a partial vacuum within the container 12, or a vacuum will naturally be induced if the container 12 or its contents are heated prior to application of the sealing disc 22. The securement member 28 together with the sealing disc 22 will be applied onto the container 12 by moving it linearly downwardly so that the circumferential inner surface of the tamper evident band 32 slips over the cylindrical sidewall portion 18 of the container 12.

In the preferred embodiment, the securement member 28 and in particular the tamper evident band 32 is preferably fabricated from a plastic material that can be heat shrunk during the packaging process. Preferably, the tamper evident band 32 is heat shrunk after the securement member 28 is properly positioned with respect to the container 12 so that the inner surface of the tamper evident band 32 becomes securely anchored through frictional engagement to the cylindrical outer sidewall portion 18 of the container 12.

Figure 2:
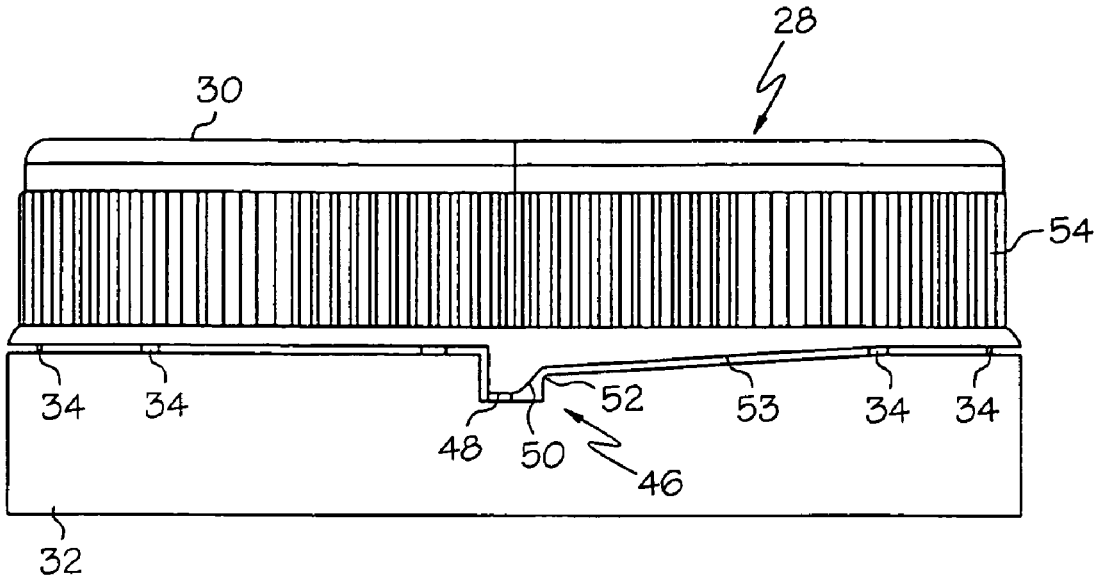
FIG. 2 is a diagrammatical side elevational view of one component of the container assembly that is depicted in FIG. 1.

Referring now to FIG. 2, it will be seen that securement member 28 further preferably includes cam structure 46 for urging the removable upper portion 30 upwardly away from the tamper evident band 32 during opening of the container assembly 10 by a consumer. In the preferred embodiment, cam structure 46 includes a first downwardly depending projection 48 that is unitary with the removable upper portion 30 and that has a first steeply sloped cam surface 50 defined in a leading edge thereof. Oppositely on the tamper evident band 32 is provided a second projection 52 and a second, more moderately sloped ramp 53. In addition, the outer circumference of the removable upper portion 30 is molded so as to include a plurality of axially extending gripping flutes 54. When a consumer desires to open the container assembly 10, he or she will be directed to twist the removable upper portion 30 of the securement member 28 in a counterclockwise direction as viewed from the top of the securement member 28 in FIG. 2. As the consumer begins to twist the removable upper portion 30, the removable upper portion 30 will begin to move in a counterclockwise direction, but the tamper evident band 32 will remain securely anchored to the cylindrical sidewall portion 18 of the container 12 as a result of the frictional engagement between those two elements. As the twisting continues, the frangible bridge elements 34 will strain, and the cam surface 50 will engage the projection 52, thereby lifting the removable upper portion 30 away from the tamper evident band 30. This combination of twisting and lifting force causes the bridge elements 34 to finally break. As the consumer continues to turn the removable upper portion 30, the projection 48 will travel on the moderately sloped ramp 53, causing the removable upper portion 30 to continue to move upwardly. As this occurs, the disc engaging structure 42 will begin to bear against the outer rim 44 of the sealing disc 22, and will eventually force the outer rim 44 upwardly to the extent that the gasket material 26 will become unsealed with respect to the upper rim 16, thereby breaking the vacuum within the container 12. In the preferred embodiment, there are two cam structures 46 at opposed sides of the closure, and the projection 48 on one side extends slightly more downward than on the other side, causing a tilting effect during opening that help to break the seal. At this point, it becomes easy for the consumer to lift the removable upper portion 30 together with the sealing disc 22 from the container 12 and to access the contents of the container 12.

Figure 3:
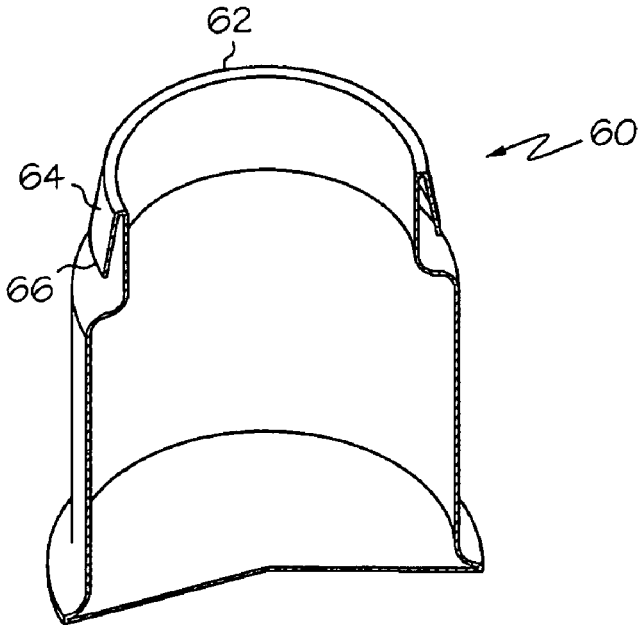
FIG. 3 is a perspective view of one component of a container assembly that is constructed according to a second embodiment of the invention.
Figure 4:
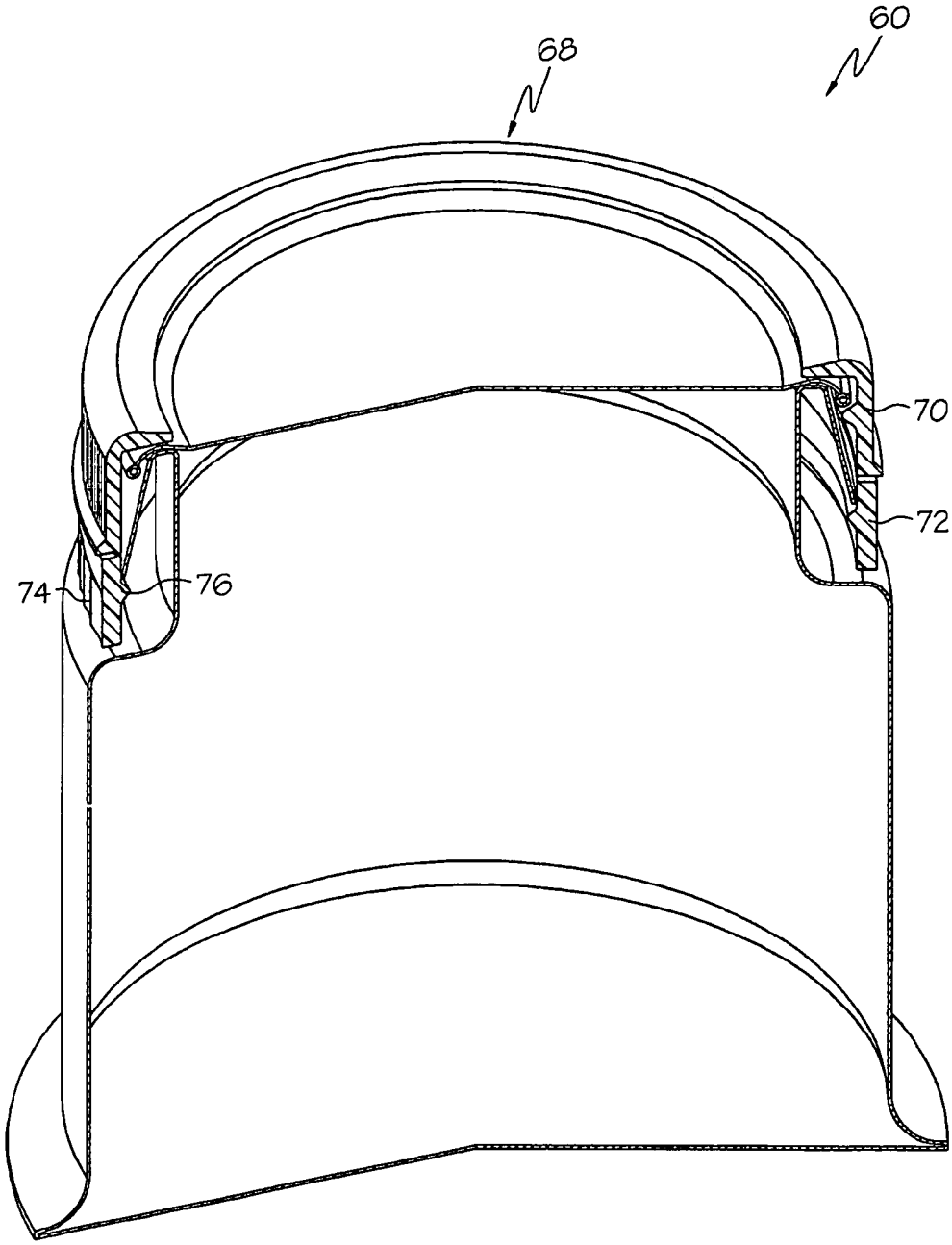
FIG. 4 is a fragmentary perspective view of the container assembly that is constructed according to the second embodiment partially shown in FIG. 3.

A container assembly 60 that is constructed according to a second embodiment of the invention is depicted in FIGS. 3 and 4. In this embodiment, an upper rim 62 is formed by folding an upper end portion of a thin metal container downwardly so as to define a metallic skirt 64 that has a lower edge 66 that is spaced outwardly from the outer surface of the neck portion of the container. Referring to FIG. 4, a securement member 68 constructed according to this embodiment of the invention is substantially identical to the securement member that is described above with reference to the first embodiment, and includes a removable upper portion 70 and a tamper evident band 72. In this embodiment, however, the tamper evident band 72 is not necessarily formed of a heat shrinkable material, but is preferably formed so as to be thick and sturdy enough to resist outward deflection during use. To this end, it may include a plurality of axial ribs 74 on its outer circumferential surface. In addition, tamper evident band 72 differs from that described above with reference to the first embodiment in that it includes one or more annular inward projections 76 that are constructed and arranged to engage the lower edge 66 of the metallic skirt 64 that are described above with reference to FIG. 3. During the packaging process, the securement member 68 will be applied linearly downwardly onto the container with the sealing disc until the annular inward projections 76 become properly seated on to the lower edge 66 of the metallic skirt 64. When the container assembly 60 is opened by a consumer, the opening process is essentially the same as described above with reference to the first embodiment, except that upward movement of the tamper evident band 72 will be prevented during opening as a result of the interaction between the annular inward projections 76 and the lower edge 66 of the metallic skirt 64, and not by frictional engagement as is the case in the first embodiment.

Figure 5:
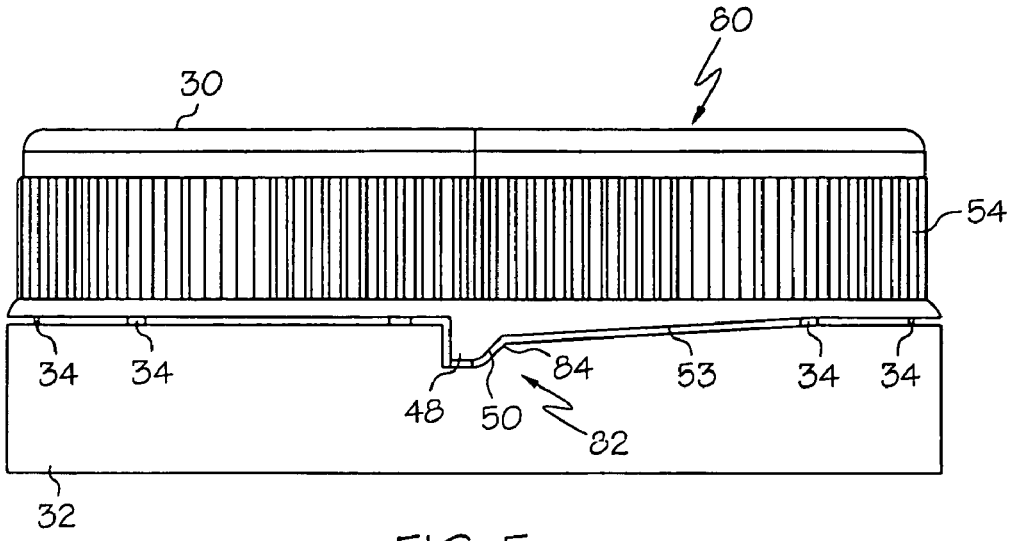
FIG. 5 is a diagrammatical side elevational view depicting an alternative embodiment to the component of the container assembly that a shown in FIG. 2.

Referring now to FIG. 5, an alternative embodiment of the invention includes a securement member 80 that is identical in all respects to the securement member 28 described above with reference to FIG. 2, with the exception that it includes alternative cam structure 82 for urging the removable upper portion 30 upwardly away from the tamper evident band 32 during opening of the container assembly 10 by a consumer. In this embodiment, the alternative cam structure 82 includes the first downwardly depending projection 48 that is described above with reference to the first embodiment, including the steeply sloped cam surface 50 that is defined in the leading edge thereof. However, on the tamper evident band 32 is provided in this embodiment a first, steeply sloped ramp surface that is preferably sloped so as to be substantially parallel to the leading edge of the projection 48. In operation, this embodiment operates substantially the same as the first described embodiment, with the exception that the forces that are generated during the initial camming motion tend to be more diffused in the interface area.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A composite closure for sealing a container having an outer surface and an opening that is defined by an upper rim, comprising:

a sealing disc that is sized and shaped to cover the opening, said sealing disc having a sealing surface on a lower side thereof that is constructed and arranged to contact and form a seal with the upper rim of the container, said sealing disc and said container being engaged so that only said sealing surface engages the container; and securement means for securing said sealing disc on the container, said securement means being heat-shrunk onto the container being securely anchored to the container through frictional engagement, said securement means further comprising a removable upper portion that is frangibly connected to the remainder of said securement means, said removable upper portion comprising disc engaging structure for engaging and lifting the sealing disc away from the upper rim of the container when said removable upper portion of said securement member is removed;

said securement means further comprising cam means, interposed between said removable upper portion and the remainder of said securement means, for exerting an upward force on said removable upper portion when said removable upper portion is being removed during opening of the closure.

2. A composite closure according to claim 1, wherein said cam means is constructed and arranged to be operative when said removable upper portion is twisted relative to the remainder of said securement means.

3. A container assembly, comprising:

a container comprising an outer surface and an opening that is defined by an upper rim, said outer surface having no threading for engaging a closure;

a sealing disc that is sized and shaped to cover the opening, said sealing disc having a sealing surface on a lower side thereof that is constructed and arranged to contact and form a seal with the upper rim of the container, said sealing disc and said container being engaged so that only said sealing surface engages the container; and securement means, removably anchored to said container, for securing said sealing disc on the container, said securement means comprising a securement member that engages an upper side of said sealing disc to prevent the sealing disc from disengaging from the upper rim of said container, and wherein said securement member further comprises a tamper evident band that is constructed and arranged to engage said container so as to prevent upward movement of said tamper evident band, whereby said tamper evident band anchors said securement member to said container in order to prevent the sealing disc from disengaging with the upper rim of said container; said securement member further comprising cam means, interposed between said tamper evident band and said removable upper portion for exerting an upward force on said removable upper portion when said removable upper portion is being removed during opening of the closure.

4. A container assembly according to claim 3, wherein said tamper evident band is constructed and arranged to frictionally engage the outer surface of the container in order to secure the tamper evident band to the container.

5. A container assembly according to claim 3, wherein said securement member further comprises a removable upper portion that is frangibly connected to said tamper evident band, said removable upper portion comprising disc engaging structure for engaging and lifting the sealing disc away from the upper rim of the container when said removable upper portion of said securement member is removed.

6. A container assembly according to claim 3, wherein said cam means comprises at least one projection on one of said tamper evident band and said removable upper portion and a ramp for engaging said projection on the other of said tamper evident band and said removable upper portion.

7. A container assembly according to claim 3, wherein said cam means is constructed and arranged to be operative when said removable upper portion is twisted relative to said tamper evident band.

8. A container assembly according to claim 7, wherein said removable upper portion comprises gripping means on an outer surface thereof for facilitating secure gripping of said removable upper portion during removable of the closure by a consumer.

9. A container assembly, comprising;

a container comprising an outer surface and an opening that is defined by an upper rim, said outer surface having no threading for engaging a closure;

a sealing disc that is sized and shaped to cover the opening, said sealing disc having a sealing surface on a lower side thereof that is constructed and arranged to contact and form a seal with the upper rim of the container, said sealing disc and said container being engaged so that only said sealing surface engages the container; and securement means, removably anchored to said container, for securing said sealing disc on the container, said securement means being heat-shrunk onto the container so that it is securely anchored to the container through frictional engagement, and wherein said securement means comprises a removable upper portion that is frangibly connected to the remainder of said securement means, said removable upper portion comprising disc engaging structure for engaging and lifting the sealing disc away from the upper rim of the container when said removable upper portion of said securement member is removed; said securement means further comprising cam means, interposed between said removable upper portion and the remainder of said securement means, for exerting an upward force on said removable upper portion when said removable upper portion is being removed during opening of the closure.

10. A container assembly according to claim 9, wherein said cam means is constructed and arranged to be operative when said removable upper portion is twisted relative to the remainder of said securement means.

* * * * *